US005435807A

United States Patent [19]

Kuhn

[11] Patent Number: 5,435,807

[45] Date of Patent: Jul. 25, 1995

[54] PROCESS FOR DYEING WOOL-CONTAINING FIBRE MATERIALS WITH ANIONIC DYES IN THE PRESENCE OF A WOOL PROTECTIVE AGENT

[75] Inventor: Martin Kuhn, Dornach, Switzerland

[73] Assignee: Ciba-Geigy Corporation, Ardsley, N.Y.

[21] Appl. No.: 126,815

[22] Filed: Sep. 24, 1993

[30] Foreign Application Priority Data

Oct. 1, 1992 [CH] Switzerland ..... 3078/92

[51] Int. Cl.[6] ..... D06P 3/16

[52] U.S. Cl. ..... 8/490; 8/533; 8/602; 8/612; 8/614; 8/127.6; 8/128.1; 8/917; 8/930

[58] Field of Search ..... 8/533, 602, 604, 612, 8/614, 917, 494, 616, 490, 128.1, 930, 127.6

[56] References Cited

U.S. PATENT DOCUMENTS

| | | | |
|---|---|---|---|
| 1,977,250 | 10/1934 | Stallmann | 8/6 |
| 1,977,252 | 10/1934 | Stallmann | 8/6 |
| 3,441,609 | 4/1969 | McKelvey et al. | 260/583 |
| 3,544,363 | 12/1970 | Rath et al. | 117/139.5 |
| 4,054,542 | 10/1977 | Buckman et al. | 260/2 |
| 4,615,709 | 10/1986 | Nakao | 8/612 |
| 4,728,337 | 3/1988 | Abel et al. | 8/606 |
| 4,838,896 | 6/1986 | Kissling et al. | 8/554 |
| 5,147,411 | 9/1992 | Töpfl | 8/612 |

FOREIGN PATENT DOCUMENTS 1543572 4/1979 United Kingdom .

OTHER PUBLICATIONS

*Colour Index,* Third Edition, vol. 4, The Society of Dyers and Colourists, 1971, p. 4475. (no month available).

Chem. Abst. vol. 70, 46819x Ger./East/61,549—Abstract—May 5, 1968.

*Primary Examiner*—Paul Lieberman
*Assistant Examiner*—Caroline L. Dusheck
*Attorney, Agent, or Firm*—George R. Dohmann

[57] ABSTRACT

A process for dyeing wool-containing fibre materials with anionic dyes, which comprises dyeing said materials in the presence of a wool protective agent which is a reaction product of an epihalohydrin and an amine of formula $$R—NH_2 \quad (1),$$

wherein R is as defined in the claims. Rubfast, level dyeings without impairment of wool quality are obtainable by the process.

8 Claims, No Drawings

PROCESS FOR DYEING WOOL-CONTAINING FIBER MATERIALS WITH ANIONIC DYES IN THE PRESENCE OF A WOOL PROTECTIVE AGENT

The present invention relates to a novel process for the high-temperature dyeing of wool or wool-containing fibre materials.

It is known in the art to dye wool or wool-containing fibre materials in the presence of dyeing assistants so as to counteract fibre damage that occurs in particular in high-temperature dyeing. Many of the known dyeing assistants contain formaldehyde or release formaldehyde upon heating, which is a matter for concern from the toxicological viewpoint.

Surprisingly, an improved process for the high-temperature dyeing of wool-containing fibre materials has-now been found that is based on the use of a novel class of wool protective agents.

Accordingly, the invention provides a process for dyeing wool-containing fibre materials with anionic dyes, which comprises dyeing said materials in the presence of a wool protective agent which is a reaction product of an epihalohydrin and an amine of formula $$R—NH_2 \quad (1),$$

wherein R is hydrogen or $C_1$–$C_6$alkyl.

R as $C_1$–$C_6$alkyl is typically n- or isopropyl, n-, iso-, sec- or tert-butyl, straight-chain or branched pentyl or hexyl or, preferably, methyl or ethyl.

R is preferably methyl or ethyl and, most preferably, hydrogen.

Suitable epihalohydrins for the preparation of the novel wool protective agents are epibromohydrin or, preferably, epichlorohydrin.

The process for the preparation of the novel wool protective agents normally comprises reacting the amine of formula (1) with excess epihalohydrin. In this reaction, a molar ratio of 1–5 mol of epihalohydrin per mol of amine of formula (1), preferably 2.5–3 mol of epihalohydrin per mol of amine of formula (1) and, most preferably, 3 mol of epihalohydrin per mol of amine of formula (1), has been found useful. The reaction is preferably carried out in an aqueous medium at temperatures of ≦100° C., and the exothermic reaction is controlled by appropriate cooling. It is preferred to bring the reactants together, conveniently by dropwise addition of the amine of formula (1) to the aqueous solution of the epihalohydrin or conversely gradually at moderate temperature in the range from 30° to 50° C., preferably from c. 40° to 45° C., and then to allow the reaction to go to completion at elevated temperature, conveniently in the range from 70° to 100° C. The reaction times can vary over a wide range, but are usually from 1 to 24 hours and, preferably, from 2 to 10 hours. The resultant solution of the reaction product can afterwards be freed from unwanted by-products in conventional manner, conveniently by subjecting it to steam distillation. The wool protective agent is obtained in the form of an aqueous solution whose water content can be determined and, if necessary, adjusted to a specific value.

The procedure ordinarily comprises dyeing the wool-containing fibre material in the presence of typically 0.5 to 10% by weight, preferably 1 to 6% by weight, of novel wool protective agent, based on the weight of the goods to be dyed.

A preferred embodiment of the invention relates to a process for dyeing wool-containing fibre materials with anionic dyes, which comprises dyeing said materials in the presence of 0.5 to 10% by weight, based on the weight of the goods, of a wool protective agent which is a reaction product of 2.5 to 3.0 molar equivalents of epichlorohydrin and 1 molar equivalent of amine of formula $$R—NH_2 \quad (1),$$

wherein R is hydrogen, methyl or ethyl.

A particularly preferred embodiment of the invention relates to a process for dyeing wool-containing fibre materials with anionic dyes, which comprises dyeing said materials in the presence of 1 to 6% by weight, based on the weight of the goods to be dyed, of a wool protective agent which is a reaction product of 2.5 to 3.0 molar equivalents of epichlorohydrin and 1 molar equivalent of ammonia.

The wool-containing fibre material may be wool itself or may consist typically of wool/polyamide or wool/polyester blends. Wool/synthetic polyamide blends are preferably dyed with anionic dyes, and wool/polyester blends are preferably dyed with disperse and anionic dyes. Those skilled in the art will be familiar with suitable anionic and disperse dyes.

The fibre material may be in any form of presentation, typically as yams, flocks, slubbing, knitted goods, bonded fibre fabrics or, preferably, wovens.

The blended fabrics are preferably wool/polyester blends that normally contain 20 to 50 parts by weight of wool and 80 to 50 parts by weight of polyester. The preferred blends for the process of this invention contain 45 parts of wool and 55 parts of polyester.

The liquor to goods ratio in the inventive process can vary over a wide range and is typically 1:1 to 1:100 and, preferably, 1:10 to 1:50.

In addition to containing the dye, water and the wool protective agent, the dyebath may contain further customary ingredients, conveniently selected from among mineral acids, organic acids and/or salts thereof which serve to adjust the pH of the dyebath, and also electrolytes, levelling agents, wetting agents and antifoams, as well as—for dyeing wool/polyester blends—carriers and/or dispersants.

The pH of the dyebath may conveniently be in the range from 4 to 6.5 and, preferably, from 5.2 to 5.8. The novel process is normally carded out in the temperature range from 60° to 130° C.

If the material to be dyed is wool alone, dyeing is preferably carried out by the exhaust process, typically in the temperature range from 60° to 106° C., preferably from 95° to 98° C. The dyeing time cart vary, depending on the requirements, but is preferably 60–120 minutes.

Polyester/wool blends are conveniently dyed in a single bath from an aqueous liquor by the exhaust process. Dyeing is preferably carded out by the high-temperature process in closed, pressure-resistant apparatus at temperatures above 100° C., conveniently from 110° to 125° C. and, preferably, from 118° to 120° C., under normal or elevated pressure.

The blended fabrics can also be dyed by the customary carrier dyeing process at temperatures below 106° C., conveniently in the temperature range from 75° to 98° C., in the presence of one or more than one carrier.

The dyeing of the polyester/wool blends can be carded out such that the goods to be dyed are treated first with the wool protective agent and, if appropriate, the carrier, and then dyed. The procedure may also be such that the goods to be dyed are treated simultaneously with the wool protective agent, the dyes and optional dyeing assistants. The preferred procedure comprises putting the textile material into a bath that contains the wool protective agent and further optional dyeing assistants and which has a temperature of 40°-50° C., and treating the material for 5 to 15 minutes at this temperature. Afterwards the temperature is raised to c. 60°-70° C., the dye is added, the dyebath is slowly heated to dyeing temperature and dyeing is carded out for c. 20-60 minutes, preferably for 30 to 45 minutes, at this temperature. At the conclusion, the liquor is cooled to about 60° C. and the dyed material is finished in customary manner.

By means of the novel process it is possible to dye wool or, preferably, wool/polyester blends at elevated temperature with full protection of the wool component, i.e. maintaining the important fibre properties of the wool, including tear strength, burst strength and elongation. It also merits special mention that the polyester component of blended fabrics exhibits no yellowing.

The invention is illustrated by the following Examples in which parts and percentages are by weight.

Preparation of the wool protective agents

EXAMPLE 1

3514 parts of deionised water and 1125 parts of a 22.7% solution of ammonia are charged to a glass flask, which has been flushed beforehand with nitrogen, and homogenised by stirring. With stirring, 4164 parts of epichlorohydrin are slowly added dropwise over about 5 hours. In the course of the reaction the temperature rises to c. 35° C. and is kept at this value for the whole dropwise addition time by external cooling. When the dropwise addition is complete, the reaction mixture is stirred for about 12 hours at room temperature, then kept for about 3.5 hours at c. 85° C., and afterwards subjected to steam distillation to expel by-products, especially 1,3-dichloropropanol and 1-chloro-2,3-propanol. The water content of the reaction solution is determined, brought to an active substance content of 50% by weight by addition of distilled water, giving 7526 parts of a yellowish, clear, almost odourless 50% solution of the wool protective agent.

EXAMPLE 2

50 parts of distilled water and 222 parts of epichlorohydrin (purity≧99.5%) are charged to a suitable glass flask, which has been flushed beforehand with nitrogen, and warmed to 35° C. With vigorous stirring, 60.5 parts of concentrated ammonia (22.5%) in 602 parts of distilled water are added dropwise. In the course of the reaction the temperature rises to c. 45° C. and is kept at this value for the whole dropwise addition time by external cooling. When the dropwise addition is complete, the reaction mixture is stirred until the exothermic reaction has subsided and then kept for about 1.5 hours at c. 80° C. The reaction mixture is then subjected to steam distillation to expel by-products, especially 1,3-dichloropropanol and 1-chloro-2,3-propanol. The water content of the reaction solution is determined, brought to an active substance content of 40% by weight by addition of distilled water, giving 518 parts of a yellowish, clear, almost odourless 40% solution of the wool protective agent.

EXAMPLE 3

The procedure of Example 1 is repeated, but replacing ammonia with the equivalent amount of ammonium hydrogencarbonate ($NH_4HCO_3$), which is reacted with epichlorohydrin at 60°-80° C. With evolution of $CO_2$, a product of comparable quality is obtained.

Dyeing Examples

EXAMPLE 4

100 parts of a blended fabric consisting of 55% polyester and 45% wool are pretreated for 5 minutes at 40° C. in a circulation dyeing machine with a liquor comprising 2.0 parts of an aqueous formulation of Example 1,
0.5 part of a sulfated fatty amine polyglycol ether,
1.0 part of a commercial assistant mixture (based on carboxylic acid and phosphoric acid aromatic compounds), and
2.0 parts of sodium acetate in 1200 parts of water, and which is adjusted to pH 5.5 with acetic acid. The liquor is heated over 30 minutes to 120° C., adding to the liquor at 70° C. 2.0 parts of the dye mixture consisting of 1.6% by weight of the dye of formula

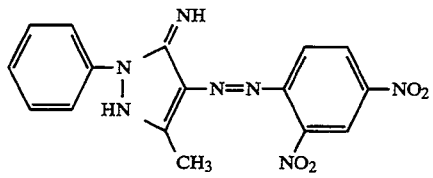

60% by weight of the dye of formula

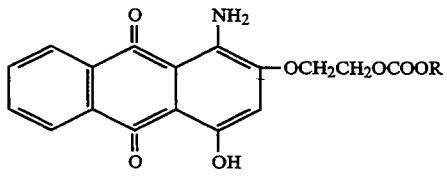

(R = 50% $-CH_2-CH_3$ + 50% $-C_6H_5$)

5.0% by weight of the dye of formula

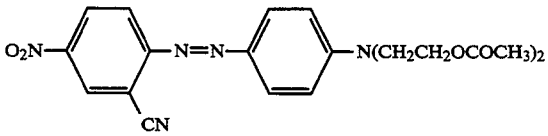

4.0 parts by weight of the dye of formula

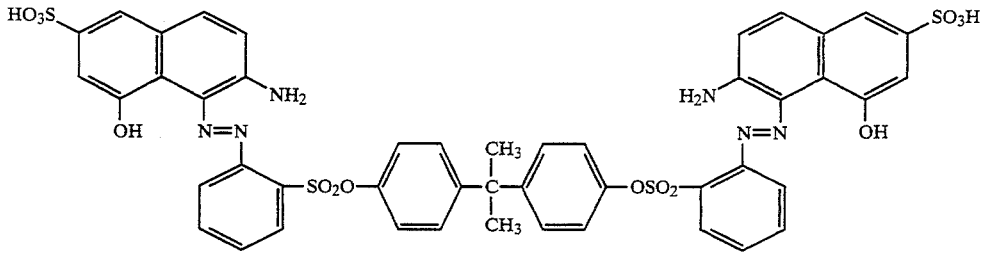

3.3 parts of the dye of formula

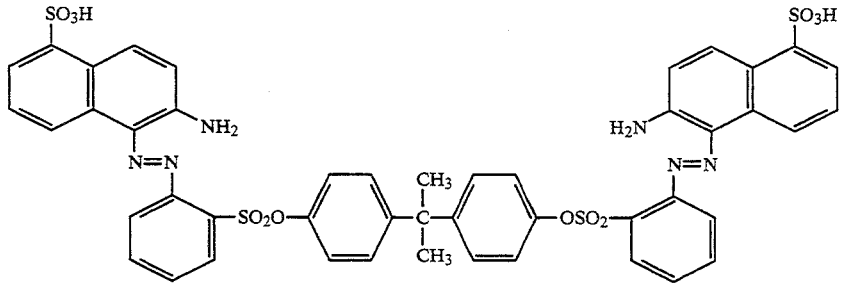

15.0 parts of the dye of formula

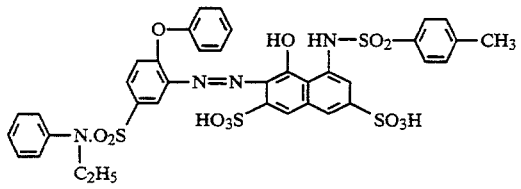

and 10 parts of sodium sulfate.

Dyeing is then carded out for 40 minutes at 120° C. and the dye liquor is afterwards cooled to 60° C. The dyed material is given a conventional washing-off, giving a rubfast, level red solid shade dyeing with no impairment of wool quality.

Dyeings of good properties and with no loss of wool quality are likwise obtained by replacing the aqueous formulation of Example 1 with (a) 2 parts of the formulation of Example 2, and (b) 2 parts of the formulation of Example 3.

EXAMPLE 5

100 parts of wool fabric having a weight of 180 $m^2/g$ treated for 10 minutes at 50° C. in 1000 parts of an aqueous liquor comprising 4 parts of ammonium sulfate, 2 parts of an aqueous formulation according to Example 1 and 0.5 part of a naphthalenesulfonic acid condensate. The pH of the liquor is adjusted to c. 6 beforehand. Afterwards 3 parts of the dye of formula

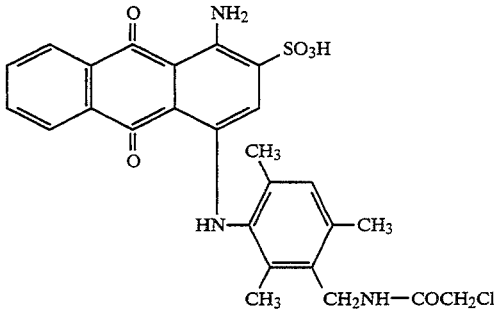

are added and the goods are treated for a further 5 minutes. The dye liquor is then heated to c. 98° C. over about 45 minutes and the fabric is dyed for 60 minutes at this temperature. The dye liquor is then cooled to c. 60° C., and the dyed goods are rinsed in conventional manner and dried to give a rubfast level blue dyeing with no impairment of the wool quality.

Dyeings of good properties and with no loss of wool quality are likewise obtained by replacing the aqueous formulation of Example 1 with (a) 2 parts of the formulation of Example 2, and (b) 2 parts of the formulation of Example 3.

EXAMPLE 6

10 parts of wool fabric and 10 parts of bleached polyester fabric are together pretreated for 5 minutes at 40° C. in 200 parts of a liquor which has been adjusted to pH 5.5 with acetic acid and which contains 0.8 part of the aqueous formulation of Example 1 and 0.4 part of sodium acetate. The liquor is then heated to 120° C. over 30 minutes and the fabric is treated for 40 minutes at this temperature. The liquor is then cooled to 60° C. and after this blank bath treatment (without dye) the wool exhibits no loss in quality, e.g. with respect to burst strength. There is likewise no yellowing of the polyester fabric caused by hydrolytic degradation of the wool.

Comparably good effects are obtained with respect to burst strength of the wool and non-yellowing of the polyester fabric by replacing the aqueous formulation of Example 1 with (a) 0.8 part of the formulation of Example 2, and (b) 0.8 part of the formulation of Example 3.

What is claimed is:

1. A process for dyeing wool-containing fibre material with an anionic dye, which comprises contacting a wool-containing material selected from the group consisting of wool, a wool/polyester blend and a wool/-polyamide blend with the anionic dye in an aqueous dyebath and applying to the wool-containing material, before or simultaneously with the application of the anionic dye, a wool protective agent which is a reaction product of an epihalohydrin and an amine of formula $$R—NH_2 \quad (1),$$

wherein R is hydrogen or $C_1$–$C_6$alkyl.

2. A process according to claim 1, wherein R is hydrogen, methyl or ethyl.

3. A process according to claim 1, wherein the epihalohydrin is epichlorohydrin.

4. A process according to claim 1, wherein the wool protective agent is the reaction product of 2.5 to 3 molar equivalents of epihalohydrin and 1 molar equivalent of amine of formula (1).

5. A process according to claim 1 for dyeing wool-containing fibre material with art anionic dye, which comprises contacting said wool-containing material with the anionic dye in an aqueous dyebath and applying to the wool-containing fibre material before or simultaneously with the application of the anionic dye 0.5 to 10% by weight, based on the weight of the wool-containing fibre material, of a wool protective agent which is a reaction product of 2.5 to 3.0 molar equivalents of epichlorohydrin and 1 molar equivalent of amine of formula $$R—NH_2 \quad (1),$$

wherein R is hydrogen, methyl or ethyl.

6. A process according to claim 1 for dyeing wool-containing fibre material with art anionic dye, which comprises contacting said wool-containing material with the anionic dye in an aqueous dyebath and applying to the wool-containing fibre material before or simultaneously with the application of the anionic dye 1 to 6% by weight, based on the weight of the wool-containing fibre material, of a wool protective agent which is a reaction product of 2.5 to 3.0 molar equivalents of epichlorohydrin and 1 molar equivalent of ammonia.

7. A process according to claim 1 for dyeing wool/-polyester blends by an exhaust dyeing process.

8. A process according to claim 1, wherein 0.5 to 10% by weight of the wool protective agent, based on the weight of the wool-containing fibre material, is applied to the wool-containing fibre material.

* * * * *